US005975511A

United States Patent [19]

Bohler

[11] Patent Number: 5,975,511

[45] Date of Patent: Nov. 2, 1999

[54] CLAMPING DEVICE WITH A JAW BRAKE

[75] Inventor: Erwin Bohler, Bettwiesen, Switzerland

[73] Assignee: Forkardt Spanntecknik AG, Switzerland

[21] Appl. No.: 08/921,174

[22] Filed: Aug. 29, 1997

[30] Foreign Application Priority Data

Apr. 13, 1997 [EP] European Pat. Off. ..... 97106054

[51] Int. Cl.[6] ..... B25B 1/20

[52] U.S. Cl. ..... 269/43; 269/154; 269/244

[58] Field of Search ..... 269/43, 242, 244, 269/906, 136, 138, 153, 154

[56] References Cited

U.S. PATENT DOCUMENTS 4,934,674 6/1990 Bernstein .

5,098,073 3/1992 Lenz ..... 269/906

5,374,040 12/1994 Lin ..... 269/43

5,649,694 7/1997 Buck .

*Primary Examiner*—Robert C. Watson

*Attorney, Agent, or Firm*—Olson & Hierl, Ltd.

[57] ABSTRACT

Clamping device for simultaneously holding several workpieces between a fixed central jaw and two endjaws situated on either side of it and joined by a threaded, lengthwise moveable spindle. A helicoidal spring surrounding the spindle urges it towards its extremity which is actuated, so that when the spindle tightened the spring elastically presses the end jaw far from the operator against a workpiece placed between said far jaw and the central jaw. This workpiece is thus immobilized even without counterpressure from the near end jaw, and need not be held by the operator who can simultaneously insert a second workpiece between the near end jaw and the central jaw with one hand and tighten the spindle with the other.

8 Claims, 2 Drawing Sheets

CLAMPING DEVICE WITH A JAW BRAKE

BACKGROUND OF THE INVENTION

Field of the Invention

The present invention relates to workholding, or clamping devices for simultaneously holding several workpieces on a machine tool, and more particularly to such a device which is able to hold one or several workpieces in place whilst it still has a pair of open jaws, so that the operator may insert one or several further workpieces between these jaws and simultaneously tighten the clamping device until it securely grips all workpieces.

Clamping devices can be mounted on the table of a machine tool and comprise vise-like jaws for fixedly maintaining one or several workpieces to be machined by the machine tool These jaws—hereafter called endjaws—are joined by a threaded spindle which can be tightened by rotating it in order to maintain at least one workpiece in a determined position relative to the machine tool. In order to speed-up the machining process, particularly on semi-automatic or automatic machine tools, it is known in the art to mount between the two end jaws of the clamping device a third jaw which is fixed relative to the main body of the device. One can then simultaneously clamp at least two workpieces in the device, by inserting one workpiece between each of the end jaws and the middle jaw. If one utilizes jaw plates, or shoes, which exactly match the shape of the workpieces, one can even maintain several workpieces between each of the end jaws and the middle jaw. Because this latter possibility remains unchanged for the invention, it will not be mentioned explicitly in the sequel; for simplicity only the case where merely two workpieces an clamped in the device, one on each side of the middle jaw will be described. An extension to the case of more workpieces is straightforward.

Now a problem occurs because when one progressively tightens the spindle, both jaws grip their respective workpiece practically simultaneously. If these pieces do not remain the desired positions, either through gravity or because of their shape, they must be manually maintained in the proper position until they are securely clamped. But one must also tighten the spindle, which practically requires three hands: two for maintaining the workpieces in place and another one for rotating the spindle. This difficulty occurs mainly when the clamping device is used in the upright position, i.e. when its spindle is oriented vertically and its jaws are positioned one above the other.

It is known in the art to provide clamping devices comprising three jaws, or on which a third jaw can be added between the end jaws, with a so-called "jaw brake", i.e. with a mechanism that allows to maintain with a sufficient force a workpiece between one endjaw and the middle jaw even when there is no workpiece between the latter and the other end jaw. The operator than has a hand free for inserting the second workpiece and maintaining it in place until he has tightened the spindle so that both workpieces are safely clamped. Conversely, this mechanism allows the operator to unload the clamping device by loosening the spindle with one hand and taking out the second workpiece whilst the first workpiece is still held by the pressure of the jaws associated with it. The ability to load and unload a clamping device in this manner is particularly useful when it must be used in a vertical position and workpieces not positively maintained by the corresponding jaws tend to drop out of the clamping device.

A known jaw brake consists of a mechanism affixed at the far end of the spindle, i.e. at its end not acted upon by the operator, on the rear side of the device.

This mechanism can be displaced axially with respect to the main body of the clamping device and has a liner slipping clutch which acts as a brake against such an axial displacement. It further comprises a compression spring one end of which remains immobile with respect to the main body of the clamping device as long as the clutch does not slip. The other end of the spring is fixed relatively to the rear end jaw. If now the clutch is in an appropriate axial position, a workpiece placed between the middle jaw and the front end jaw, and then the spindle progressively tightened, the spring will stop the rear end jaw from moving towards the middle jaw until the workpiece is clamped. Once it has been clamped, a further tightening of the spindle generates an increasing pressure on it and maintains it in place whilst the second workpiece is being inserted. After this the spindle can be fully tightened. If the second workpiece is so small that the stroke of the spring is exceeded before said workpiece is clamped, the clutch will slip and thus protect the device from damage.

Although such brakes are fully functional, they have a number of drawbacks. Adjusting their axial position and securing it by activating the linear clutch is troublesome and must be done at the far end of the device, furthest away from the operator. It is moreover necessary to remove the rear end jaw in order to activate the brake, and a similar difficulty arises when one wishes to regulate the force of the clutch which must usually be done by adjusting a screw by an unknown amount. Further, the overall dimensions of the brake are necessarily small because a part of it must be located in the recess intended for the spindle and may therefore not exceed the diameter of the letter. This enforced small size limits the dimension of the compression spring and hence its gripping power, but also the robustness of the entire brake.

BRIEF SUMMARY OF THE INVENTION

In order to avoid the aforesaid drawbacks and to obtain further advantages, invention is defined as recited in claim 1. The location of the helicoidal spring within the device and the fact that it urges the front and jaw of the device make it possible to place it inside the device in a spot where it can be protected from dirt without requiring numerous additional seals and where there also is enough room to accommodate a strong spring and a robust mechanism. Because this mechanism is located near the front end of the device, its controls are easily accessible. The invention will now be explained in further detail through the description of embodiments of the same and with the help of the drawing, where

DESCRIPTION OF PREFERRED EMBODIMENTS

Figure 1:
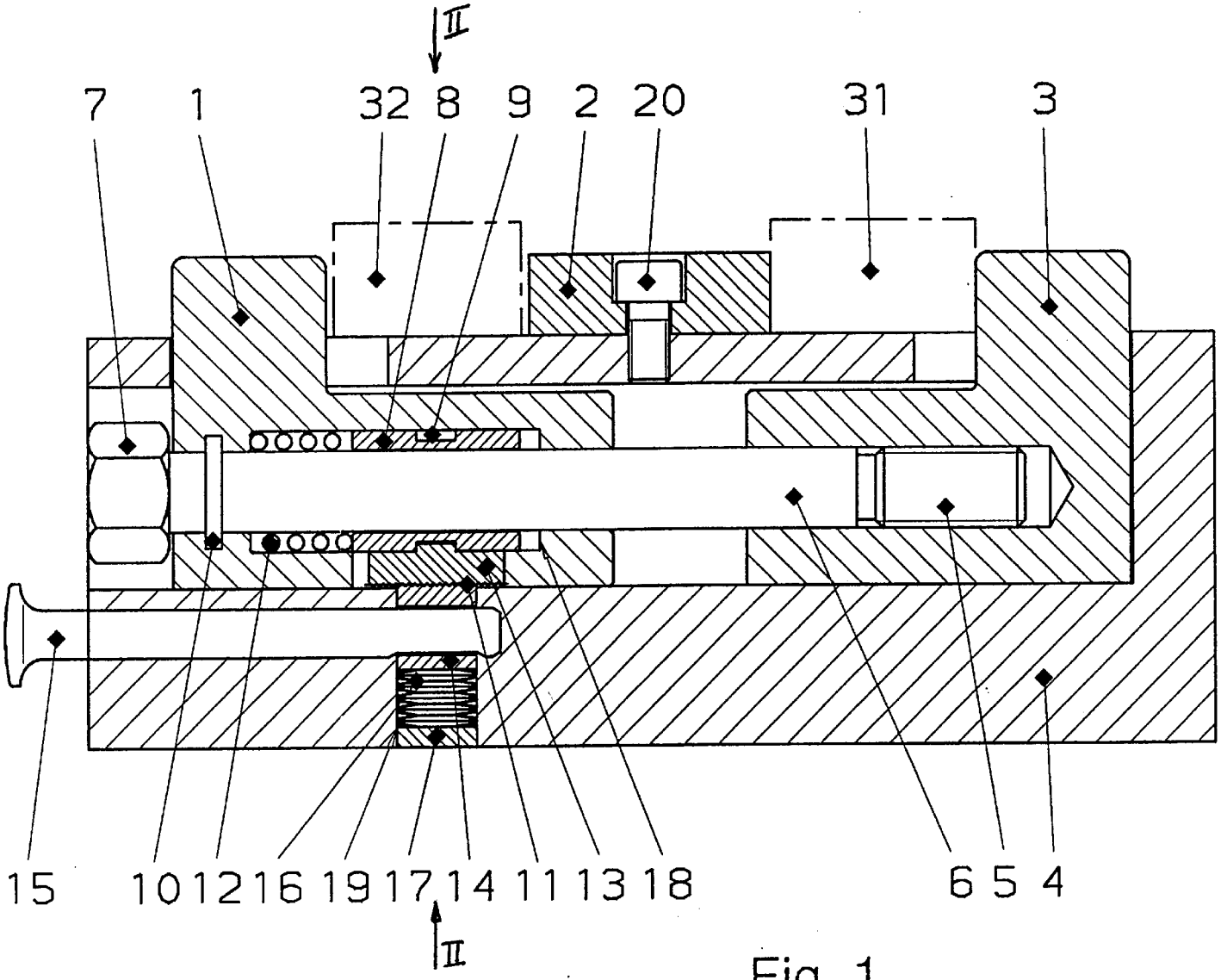
FIG. 1 schematically shows a section through a simple implementation of the invention, and FIG. 2 schematically shows a section along a plane corresponding to line II—II of FIG. 1, through a second, preferred realization of the invention.

In the schematic section shown in FIG. 1, numeral 1 identifies the front end jaw and 3 the rear end jaw of a clamping device. To simplify the description, the term "jaw"

will not be used in a restricted sense merely for the jaw itself, but more generally for parts which are bound to a jaw so that they move axially with the same. As usual, both end jaws are mounted, in a way not shown, on rails fixed to the main body 4 (only partially shown) of the clamping device. A threaded spindle 6 joins the end jaws which can thus be moved together in the axial direction of the spindle. A middle jaw 2 is removably fixed to the main body 4 of the device by a screw 20; it must be present to use the clamping device in the way considered here. The spindle 6 can be rotated, but not displaced lengthwise with respect to the front end jaw 1. A collar 10 stops it from moving lengthwise with respect to this jaw, and a thread 5 at the other end of the spindle engages the rear end jaw 3. The spindle can be rotated with the help of a tool (not shown) that engages its head 7, whereby the end jaws 1 & 3 are brought nearer together or further apart. A sleeve 8 with an annular grove 9 on its outer surface is mounted slidably on the cylindric shaft of the spindle and is urged backwards, away from the front end jaw 1, (i.e. towards the thread 5 of the spindle which engages the rear end jaw 3), by a helicoidal spring 12 disposed around the spindle 6. A pusher 13 in the shape of a small plate is guided so that it can freely move in the axial direction only; on its side facing the spindle it comprises a finger that engages in the annular grove 9 of the sleeve 8, so that sleeve and pusher are forced to move together in the axial direction. On its face opposite to the finger, the pusher 13 is fluted, with ripples oriented transversally to the axial direction of the spindle. These ripples cooperate will those of a corresponding fluted surface at the bottom of a piston 14. This piston is engaged in a bore hole of the main body 4 and is oriented so that its axis intersects the axis of the spindle 6 at right angle. A pack of cup springs 16 placed in the bore hole is restrained by a headless screw 17 so that it urges the piston 14 towards the pusher 13. A cylindrical bore hole traverses the piston transversally, and an axially oriented bolt 15 is engaged in this bore hole. The section of the bolt housed in the bore is flattened on one side or excentrically shaped and act as an excenter cam when the bolt is rotated. The dimensions of the excenter and of the bore hole that houses it are chosen so that when the bolt 15 is positioned as shown in FIG. 1 the piston 14 will be forced far enough upwards by the pressure of the pack of cup springs 16 to ensure that the ripples on the fluted bottom of the piston 14 engage those the pusher 13 with a force determined by the cup springs 16 and the depth at which the headless screw 17 is screwed in. Due to the mutual engagement of the two fluted surfaces, the spring 12 which rests against the sleeve 8 held by the pusher 13 urges both end jaws towards the left in FIG. 1, either until shoulder 18 belonging to the front jaw meets the sleeve 8 or until a rear workpiece 31 inserted between the middle jaw 2 and the rear end jaw 3 stops a further movement of both end jaws 1 and 3 with respect to the middle jaw 2. In the latter case, if one further tightens the spindle 6, the force with which the spring 12 presses the rear workpiece 31 between the rear jaw 3 and the middle jaw 2 increases and will eventually suffice to maintain the workpiece in place; one hand of the operator is then free to insert a second workpiece 32 between the front end jaw 1 and the middle jaw 2. Thereafter the spindle 6 can be tightened further against the force of the spring 12 until it clamps both workpieces with the desired force. If one either forgets to insert a forward workpiece 32, or else if the displacement needed in order to grip it is so large that the spring 12 becomes totally compressed before the front workpiece is properly clamped, the fluted surfaces of the pusher 8 and of the piston 14 will ratchet out stepwise against the pressure applied by the cup springs 16 before any damage occurs. The force necessary to disengage the fluted surfaces determines the largest clamping force that can be exerted on the rear workpiece 31 without help from the front workpiece 32, and can be adjusted with the headless screw 17.

The interaction between the fluted surfaces of the pusher 8 and the piston 14 can be used as follows for adapting the distances separating the jaws to workpieces with different sizes. First the bolt 15 is rotated by 180° with respect to its position shown in FIG. 1. Its eccentric part thereby pushes the piston 14 downwards against the force of the cup springs 16, and the fluting of the piston disengages from that of the pusher 13 so that the pusher together with the sleeve 8 can move in the axial direction independently of the middle jaw 2. As a result the spring 12 pushes the sleeve 8 towards the shoulder 18. One then places the front workpiece 32 against the middle jaw 2 and pushes the front end jaw near it. A half turn of the bolt 15 than lets the piston move upwards so that its fluting meshes with that of the pusher 13. The jaw brake is now adjusted and activated. Thereafter the rear workpiece 31 is always inserted first. Tightening the spindle then pushes the rear jaw against the middle jaw 2 until the rear workpiece 31 is maintained by the force of the spring 12. This frees one hand of the operator who can place the front workpiece 32 between the front end jaw 1 and the middle jaw 2; the position then is approximately as shown in FIG. 1. Finally, a further tightening of the spindle 6 clamps both workpieces 31, 32 with the desired force between the end jaws 1, 2, respectively, and the middle jaw 2. If this action pushes the front and jaw 1 so far against the immobilized sleeve 8 that the spring 12 is totally compressed, i.e. beyond the rated free path of the spring, the flutings of the piston 14 and the pusher 13 disengage and thereby protect the device from damage. Unloading the device occurs in the reverse order: first one slackens the spindle a little and removes the front workpiece 32 which has thus been freed whilst the rear workpiece 31 is still held by the force of the spring 12; thereafter one releases the spindle further until either the rear and jaw 3 exerts no force on the rear workpiece 31 anymore, or until this force is small enough to allow an easy removal of the rear workpiece.

The above embodiment has been described because all its parts relevant to the invention can be viewed in a single central section which clearly illustrates the gist of the invention. Note that in actual practice one skilled in the art may prefer an embodiment where the axial immobilization of the sleeve 8 is mechanically more symmetrical, and the headless adjusting screw 17 more easily accessible than in FIG. 1, where it must be adjusted from undeneath the body of the clamping device.

Figure 2:
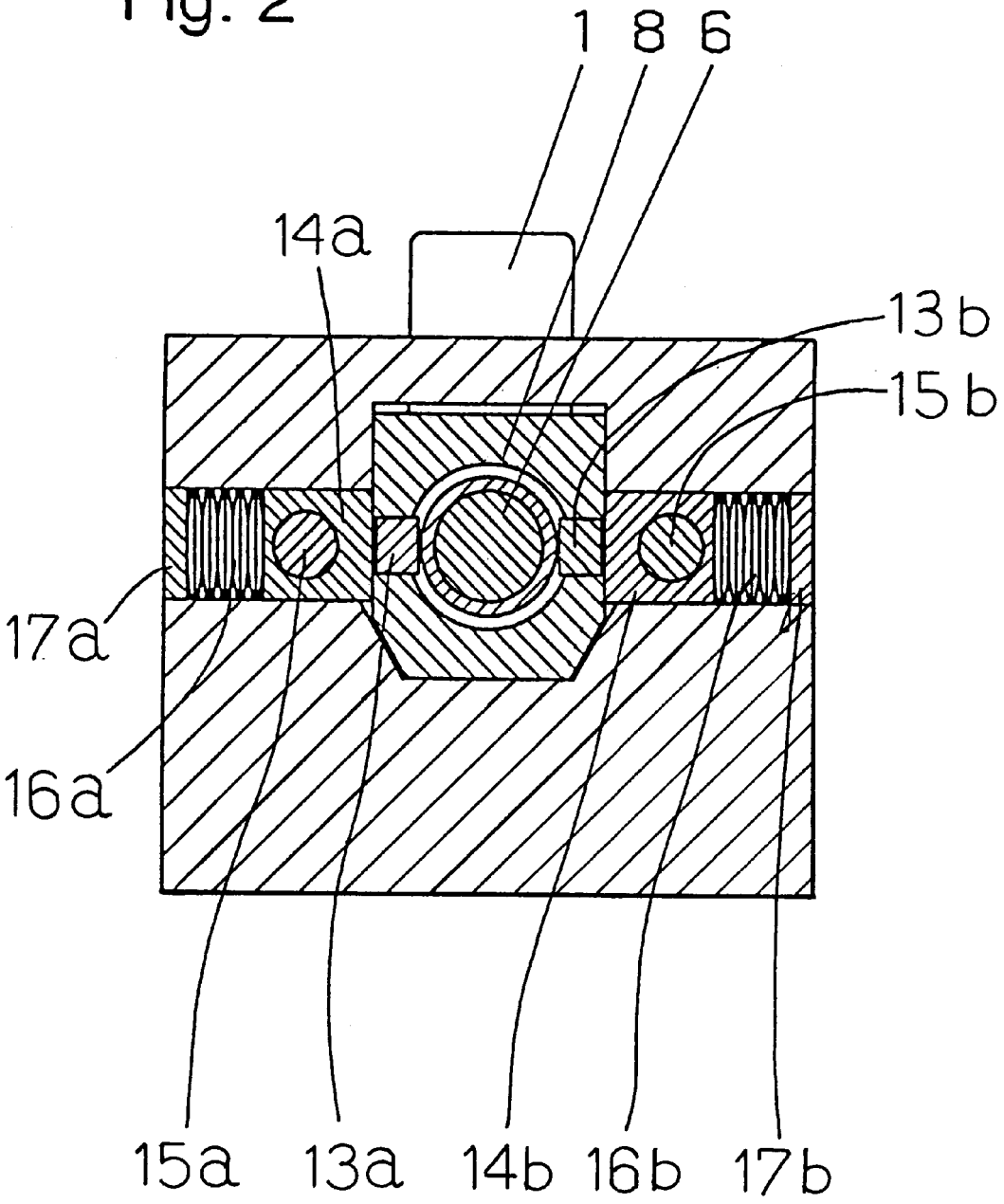

Therefore a second embodiment will be briefly sketched, with reference to FIG. 2 representing a section corresponding to the plane II—II of FIG. 1 for a device with one ratchet device on each side of the spindle instead of a single one beneath it. This embodiment it similar to that shown in FIG. 1, save for the ratchet device consisting of the pusher 13, the piston 14, the pack of cup springs 16, the headless screw 17 and the bolt 15. This ratchet device which was placed vertically below the spindle 6 in the preceding embodiment is here replaced by a pair of similar devices symmetrically placed to the right and left of the spindle as shown in FIG. 2 which represents a section normal to the spindle at a place corresponding to the plane II—II in FIG. 1.

The bolt 15 of FIG. 1 is replaced by a pair of bolts 15*a*, 15*b* placed symmetrically on either side of the threaded spindle 6, and the axis' of which lie in the same horizontal plane as that of the spindle. Likewise, the headless screw 17, the cup springs 16, the piston 14 and the pusher 13 are each replaced by a pair of equivalent means 17*a*, 17*b*; 16*a*, 16*b*; 14*a*, 14*b*; 13*a*, 13*b*, disposed symmetrically on either side of the spindle 6 as shown in FIG. 2. With this disposition the forces exerted by the two pushers 13*a*, 13*b* urge the sleeve 8 axially at two diametrically opposed places which is preferable to the one-sided action obtained with the embodiment of FIG. 1. Further, the openings though which the headless screws 17*a*, 17*b* must be adjusted are situated on either side of the clamping device and therefore more easily accessible than the single headless screw 17 of FIG. 1.

I claim:

1. A clamping device for simultaneously clamping several workpieces between a first and a second end jaw linked by a spindle that generates the clamping force and a middle jaw intermediate between said two end jaws, the spindle being slidable lengthwise with respect to the middle jaw, characterized in that the spindle is rotatable but axially immobilized relative to the first jaw and threadedly connected with the second jaw, that a helicoidal spring is located around the shaft of the spindle and arranged so as to urge the spindle with respect to the middle jaw in a direction that brings the second jaw closer to the middle jaw, the transmission of force between the spring and the middle jaw occurring through a sleeve coaxial with the spindle and slidable relative to it in its longitudinal direction.

2. A clamping device according to claim 1, characterized in that the transmission of axial forces between the sleeve and the middle jaw occurs through two similar mechanical assemblies placed diametrically with respect to the axis of the spindle.

3. A clamping device according to claim 2, characterized in that the axial force between the sleeve and the middle jaw is transmitted through at least one elastically releasable ratchet device.

4. A clamping device according to claim 3, characterized in that the ratchet device or devices each comprise an axially movable slide with a dog engaged in a circular groove on the outer surface of the sleeve and a first fluted surface, where the latter engages with a second fluted surface immobile in axial direction with respect to the middle jaw, so that both fluted surfaces together form a spring-loaded ratchet.

5. A clamping device according to claim 4, characterized in that the ratchet device or devices can be disabled.

6. A clamping device according to claim 5, characterized in that the second fluted surface is formed on the bottom of a piston slideably mounted in a bore hole of a body immobile with respect to the middle jaw, the piston being urged by a pretensionning spring towards the first fluted surface and having a transversal passage in which an excenter is lodged so that a rotation of the excenter displaces the piston against the force of the pretensionning spring by an amount sufficient to disengage the two fluted surfaces from each other.

7. A clamping device according to claim 6, characterized in that the middle jaw is a removable jaw mounted on the main body of the clamping device so as to remain immobile with respect to it.

8. A clamping device according to claim 7, characterized in that the dimensions of the helicoidal spring are chosen such that it can exert on the end jaws a maximal force at least equal to 500 N.

* * * * *